US009117098B2

(12) United States Patent
Trombley et al.

(10) Patent No.: US 9,117,098 B2
(45) Date of Patent: Aug. 25, 2015

(54) ON-BOARD TRAFFIC DENSITY ESTIMATOR

(71) Applicant: FORD GLOBAL TECHNOLOGIES, LLC, Dearborn, MI (US)

(72) Inventors: Roger A. Trombley, Ann Arbor, MI (US); Thomas E. Plutti, Ann Arbor, MI (US); Kwaku O. Prakah-Asante, Commerce Township, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 7 days.

(21) Appl. No.: 13/908,386

(22) Filed: Jun. 3, 2013

(65) Prior Publication Data

US 2014/0358413 A1 Dec. 4, 2014

(51) Int. Cl.

| | |
|---|---|
| ***G08G 1/00*** | (2006.01) |
| ***G06G 1/00*** | (2006.01) |
| ***G08G 1/01*** | (2006.01) |
| *G08G 1/04* | (2006.01) |

(52) U.S. Cl.

CPC ..... *G06G 1/00* (2013.01); *G08G 1/0112* (2013.01); *G08G 1/0129* (2013.01); *G08G 1/04* (2013.01)

(58) Field of Classification Search

CPC ..... G08G 1/00; G08G 1/0112; G08G 1/0133; G08G 1/017; G08G 1/04; G08G 1/056

USPC ..... 701/118, 300; 342/454; 340/934

See application file for complete search history.

(56) References Cited

U.S. PATENT DOCUMENTS

| | | | | |
|---|---|---|---|---|
| 5,629,851 | A * | 5/1997 | Williams et al. | 701/96 |
| 5,999,874 | A * | 12/1999 | Winner et al. | 701/93 |
| 6,094,616 | A * | 7/2000 | Andreas et al. | 701/96 |
| 6,580,996 | B1 * | 6/2003 | Friedrich | 701/96 |
| 7,188,025 | B2 | 3/2007 | Hudson, Jr. | |
| 7,706,963 | B2 | 4/2010 | Parikh et al. | |
| 2002/0021229 | A1 * | 2/2002 | Stein | 340/933 |
| 2011/0093177 | A1 * | 4/2011 | Horn | 701/70 |
| 2011/0173015 | A1 | 7/2011 | Chapman et al. | |

(Continued)

FOREIGN PATENT DOCUMENTS

JP 2010036862 A * 2/2010

OTHER PUBLICATIONS

Mathew et al., Introduction to Transportation Engineering: Ch. 30, Fundamental Parameters of Traffic Flow, May 2007.*

(Continued)

*Primary Examiner* — John Q Nguyen
*Assistant Examiner* — Nadeem Odeh
(74) *Attorney, Agent, or Firm* — Frank MacKenzie; MacMillan, Sobanski & Todd, LLC

(57) ABSTRACT

Traffic density is estimated around a host vehicle moving on a roadway. An object detection system remotely senses and identifies the positions of nearby vehicles. A controller a) predicts a path of a host lane being driven by the host vehicle, b) bins the nearby vehicles into a plurality of lanes including the host lane and one or more adjacent lanes flanking the predicted path, c) determines a host lane distance in response to a position of a farthest vehicle that is binned to the host lane, d) determines an adjacent lane distance in response to a difference between a closest position in an adjacent lane that is within the field of view and a position of a farthest vehicle binned to the adjacent lane, and e) indicates a traffic density in response to a ratio between a count of the binned vehicles and a sum of the distances.

17 Claims, 4 Drawing Sheets

(56) References Cited

U.S. PATENT DOCUMENTS

2011/0246052 A1 10/2011 Zaitsu
2012/0268295 A1* 10/2012 Yuse et al. ..... 340/905

OTHER PUBLICATIONS

Pelcovits et al., Barron's AP Physics C, 2009, Barron's Educational Series, 2nd Edition, p. 274.*

Childress, Notes on Traffic Flow, Mar. 2005.*

Machine Translation: Taguchi et al., Travel Control Device and Travel Control System, JP 2010-036862 A, Feb. 2010, Japanese Patent Office Publication.*

Delphi Electronically Scanning Radar Brochure, delphi.com/shared/pdf/ppd/safesec/esr.pdf, accessed May 17, 2013.

* cited by examiner

ON-BOARD TRAFFIC DENSITY ESTIMATOR

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to monitoring traffic surrounding a motor vehicle, and, more specifically, to a method and apparatus for classifying on-board and in real time a traffic density within which a host vehicle is moving.

For a variety of automotive systems and functions, it can be useful to have available an estimate of local traffic density (including estimations of traffic density in the direct forward path of the vehicle, in adjacent lanes, and an aggregate or overall traffic density in the vicinity of the vehicle). For example, the warning thresholds (e.g., distances or buffer zones) for a collision warning system may be adjusted depending on whether traffic density is light, medium, or heavy. In addition, a driver alertness monitoring system may use different thresholds according to the traffic density.

Conventionally, traffic density estimations have been obtained in various ways. In one automated technique, a rough estimate of traffic density is found by tracking cell phones passing through designated roadway locations (e.g., a central monitor obtains GPS or cell tower-based coordinates of individual phones, maps them onto roadway segments, calculates a vehicle density, and communicates the result to the vehicles). Other automated techniques for counting the number of vehicles present at a road segment can also be used. These approaches give only a general idea of how many vehicles are within a fixed area (i.e., not specific to the immediate area around any particular vehicle). They have other disadvantages including that the update rate is slow, the vehicle must have wireless communication in order to access the information, and infrastructure must be provided for performing the calculations outside of the host vehicle.

In another approach, drivers or other observers may visually characterize the amount of traffic in an area. This is subject to the same disadvantages, and may be less accurate. In yet another approach, a Vehicle-to-Infrastructure system may be used to characterize the traffic density. This is subject to high costs of implementing hardware on both the vehicles and the roadside. Additionally, a sufficient market penetration would be needed in order for this to be feasible.

SUMMARY OF THE INVENTION

In one aspect of the invention, a method is provided for an electronic controller in a host vehicle to determine a traffic density. A sensor remotely senses objects within a field of view around the host vehicle. Positions are identified of nearby vehicles within the sensed objects. A path of a host lane being driven by the host vehicle is predicted. The electronic controller bins the nearby vehicles into a plurality of lanes including the host lane and one or more adjacent lanes flanking the predicted path. The electronic controller determines a host lane distance in response to a position of a farthest vehicle that is binned to the host lane, and then determines an adjacent lane distance in response to a difference between a closest position in an adjacent lane that is within the field of view and a position of a farthest vehicle binned to the adjacent lane. The electronic controller indicates a traffic density in response to a ratio between a count of the binned vehicles and a sum of the distances.

In a preferred embodiment, the vehicle locations on the surrounding roadway are estimated through the use of an on-board forward looking sensor. Additional vehicle sensors such as side looking blind spot sensors or rear looking sensors can also be used.

The relative positions of nearby vehicles (laterally and longitudinally) are acquired from the forward looking sensor. This can be either directly in Cartesian form or calculated from polar coordinates. All of the target vehicles that are detected by the forward looking sensor are then be binned into "lanes" based on their offset from the predicted path of the host vehicle. The predicted path may be determined from a yaw rate sensor or GPS Map data, for example. Based on a typical lane width, the host lane is considered to occupy an area +/− one-half of the lane width around the predicted path. An adjacent lane to the right of the host measured from the host's center line goes from +½ lane width to +1½ lane width, while an adjacent lane to the left measured from the host's center line goes from −½ lane width to −1½ lane width. This calculation can be carried out to any desired number of total lanes of interest.

With the vehicles all binned to lanes, a count is then performed to determine the total number of vehicles that are seen in each lane. For the host vehicle's lane, the count should include the host vehicle. To complete a density calculation, a value for the monitored distance within each lane is needed. For the host's lane, this is done by determining which vehicle is the farthest forward in the host's lane. The length of the host vehicle and an estimate of the most forward vehicle's length are preferably added to the longitudinal relative position measured from the front of the host vehicle to the rear of the most forward in lane vehicle to yield a longitudinal distance in which vehicles are seen for the host's lane. If no forward vehicles are seen, then the distance may default to the maximum reliable detection distance of the sensor.

For the adjacent lanes, a distance is preferably determined in response to the field of view from the location of the forward looking sensor to determine the closest point to the host vehicle that a vehicle in the adjacent lane could be detected. This detection distance is then subtracted from the longitudinal relative position of the most forward vehicle in the adjacent lane (preferably again adding a length estimate for the detected vehicle and defaulting to a maximum detection distance if no vehicles are found). The ratio of each respective count to the respective detection distance gives the traffic density for the respective lane. An overall density is obtained from the ratio of the total count to the summed distances.

DETAILED DESCRIPTION OF PREFERRED EMBODIMENTS

Figure 1:
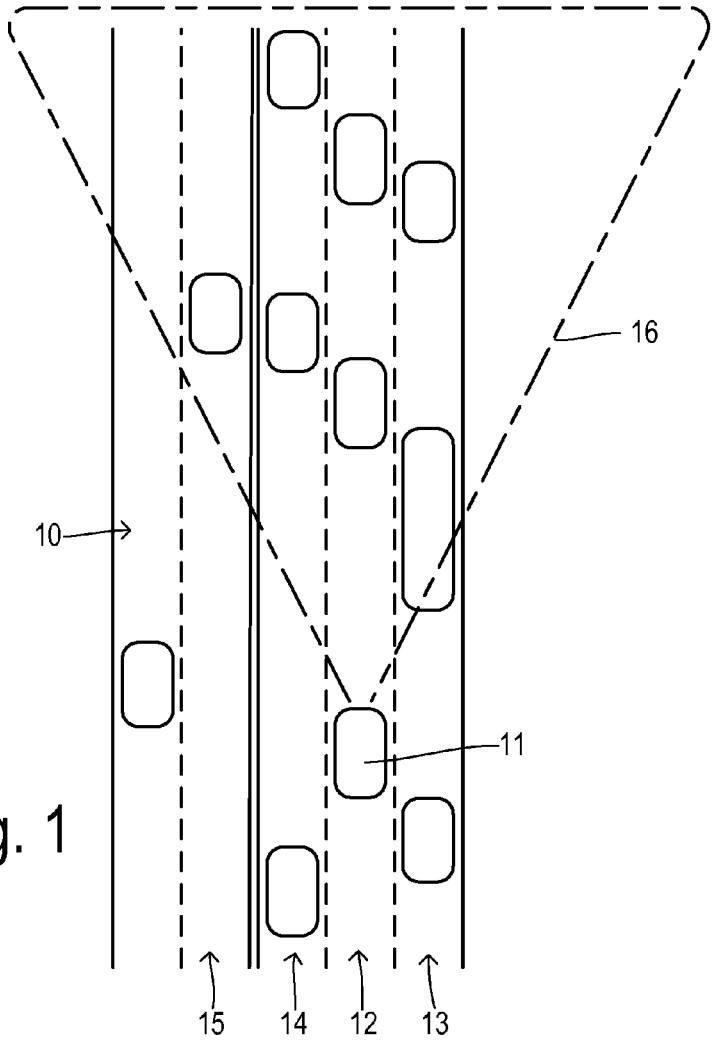
FIG. 1 shows a host vehicle on a roadway with surrounding traffic.

Referring now to FIG. 1, a divided roadway 10 is being traversed by a host vehicle 11 moving along a host lane 12 which is flanked by a right adjacent lane 13 and a left adjacent lane 14. A second left adjacent lane 15 carries opposing traffic. Host vehicle 11 is equipped with a forward-looking remote object recognition and tracking system which may be comprised of a commercial, off-the-shelf remote sensing system such as the ESR electronically scanning radar system available from Delphi Automotive LLP or the forward looking safety system available from TRW Automotive Holdings Corporation. The systems may employ radar sensors and/or optical camera or video systems to sense remote objects within a field of view around the host vehicle and to track distinct objects over time. As a result of the tracking, the systems report a list of objects comprising an identification of each type of object, its relative position, and its current movement. As shown in FIG. 1, the object detection system may have a field of view 16 which in this preferred embodiment corresponds to a forward-looking system.

Figure 2:
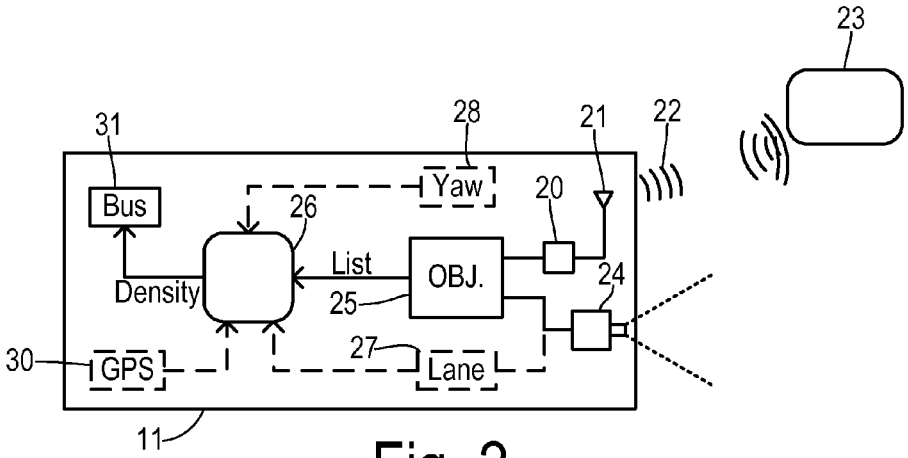
FIG. 2 is a block diagram of one embodiment of vehicle apparatus according to the present invention.

FIG. 2 shows host vehicle 11 with components for implementing the present invention. A radar transceiver 20 is coupled with a radar antenna 21 to transmit scanning radar signals 22 and then receiving reflected signals from a nearby object 23 (such as an adjacent vehicle). Remote objects may also be optically detected (e.g., in visible light) using a camera system 24. Transceiver 20 and camera 24 are coupled to an object detection and tracking module 25 of a conventional design to provide an integrated remote object detection system which provides a list of tracked objects to a traffic density control module 26. For each object being tracked, the list may include various parameters including but not limited to a relative position, type of object (e.g., car or large truck), relative velocity, and/or absolute velocity.

In operation, traffic density controller 26 identifies a predicted path of the host vehicle in one of several ways. For example, an optically-based lane detection system 27 coupled to camera 24 may employ pattern recognition to detect lane markers or other features to locate the roadway lanes. Thus, the paths of the host lane and adjacent lanes may be fed directly to controller 26. Alternatively, a vehicle yaw sensor 28 may be coupled to controller 26 for providing lateral acceleration information to be used by controller 26 to predict the lane path. In another alternative, a GPS navigation/mapping system 30 may be coupled to controller 26 for identifying lane locations based on using detected geographic coordinates of host vehicle 11 as a pointer onto a roadway map.

Based upon vehicle counts and lane distances as determined below, controller 26 generates traffic density indications for the purpose of providing them to other appropriate controllers (not shown) and/or functions that modify their performance in accordance with the traffic density. The indications may be communicated within the vehicle over a multiplex bus 31. Based on the indicated traffic density, the other systems may adjust thresholds or other aspects of their system operation to account for the actual traffic conditions determined in the immediate vicinity of the host vehicle on-board and in real-time.

Figure 3A:
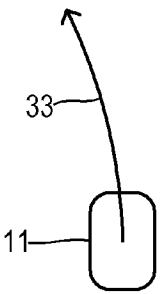
FIGS. 3A and 3B show a vehicle's predicted path and potential lane positions corresponding to the predicted path.
Figure 3B:
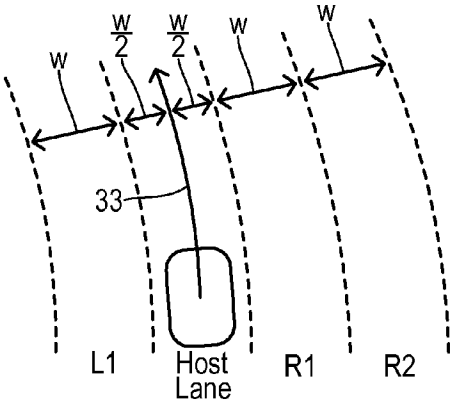

As shown in FIG. 3A, host vehicle 11 has a predicted path 33 which may be used to infer the upcoming area traversed by a host lane. When using a yaw sensor in order to predict the vehicle path based on lateral acceleration, a sufficiently low or substantially zero lateral acceleration leads to a prediction of a straight lane path. Larger lateral accelerations lead to prediction of an increasingly curved lane path. As shown in FIG. 3B, the predicted course of the host lane is centered on predicted path 33 and extends by ½ of a predetermined lane width W to either side. Based on the predicted course of the host lane, a plurality of adjacent lane paths are defined including a left adjacent path L1, a right adjacent lane path R1, and a second right lateral adjacent lane path R2 flanking the host lane in a parallel manner.

Figure 4:
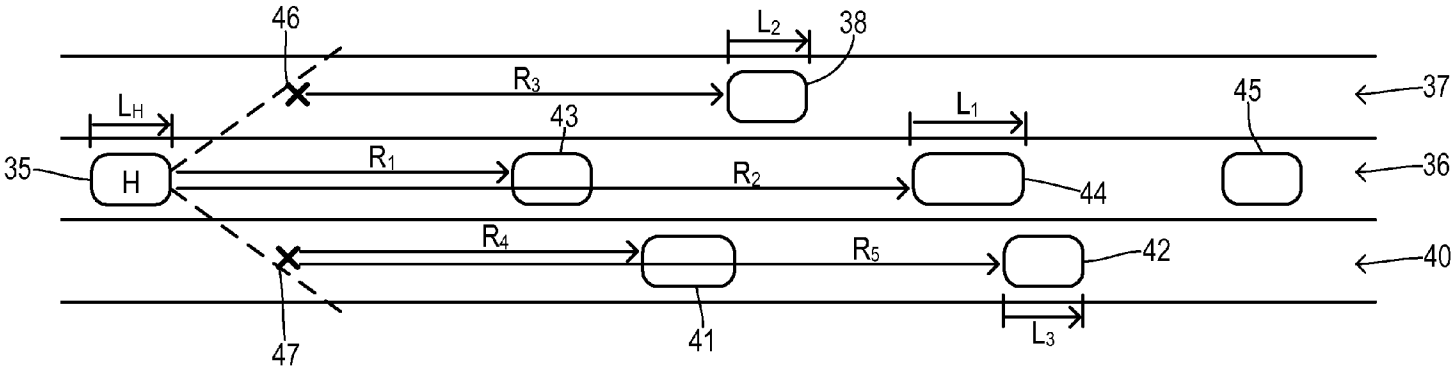
FIG. 4 is a diagram showing nearby vehicles binned to respective lanes with their ranges from the host vehicle or from the position in an adjacent lane where the vehicle would enter the sensor field of view.

Once the host and adjacent lanes have been laid out relative to the position of the host vehicle, each tracked vehicle can be binned according to the areas covered by the lanes. FIG. 4 shows an example of binned vehicles relative to a host vehicle 35 in a host lane 36. Although four vehicles are shown in host lane 36, an actual vehicle count of three is obtained (i.e., vehicles 35, 43, and 44 are counted). A vehicle 45 which is within a maximum detection distance of the object detection system is not counted because it is not detected (e.g., vehicle 44 is a large truck and blocks the potential view of vehicle 45). For a left adjacent lane 37, a lane count of one would result because of the presence of a vehicle 38. In a right adjacent lane 40, a vehicle count of two is obtained due to the presence of vehicles 41 and 42.

With the count information obtained, the next step is to derive the roadway distances over which the counted vehicles are distributed. Within the field of view of the remote sensors, there is a maximum detection distance for sensing any vehicles that may be present. Whenever vehicles are present, however, the view out to the maximum distance may be blocked by a detected vehicle. In the example of FIG. 4, the vehicles counted in host lane 36 include vehicle 43 detected at a range $R_1$ and vehicle 44 detected at a range $R_2$. Undetected vehicle 45 which is present in lane 36 does not contribute to the count, and the corresponding portion of host lane 36 should not contribute to the density calculation. Therefore, the distance within each respective lane to be used in the density calculation corresponds with a farthest vehicle that is binned to that lane. In host lane 36, the farthest vehicle is vehicle 44 so that the host lane distance is comprised of range $R_2$ between host vehicle 35 and vehicle 44. Preferably, the distance used for calculating density also comprises the addition of a length $L_H$ of the host vehicle and a length $L_1$ for vehicle 44.

In an adjacent lane to the side of host vehicle 35, the appropriate distance to be used as a basis for the density calculation usually does not begin at a point even with the host vehicle because the field of view for the sensing system is unlikely to correspond with the exact front of host vehicle 35. When using just a forward-looking detector, a vehicle in an adjacent lane must be at least slightly ahead of host vehicle 35 in order to be detected. Locations 46 and 47 in the adjacent lanes correspond to a closest position in those adjacent lanes that is within the field of view of the sensors. These locations can be measured in advance during the design of the vehicle.

For an object detection system with other types of sensors, the beginning position for the distance measurement can be at other positions relative to the host vehicle. For detectors with side-looking sensors or rear-looking sensors, the starting position for determining adjacent lane distances could even be behind host vehicle 35 or could be defined according to a farthest detected adjacent vehicle behind the host vehicle.

For right adjacent lane 40, the adjacent lane distance to be used in the traffic density calculation comprises a range $R_5$ between position 47 and a farthest vehicle 42 in lane 40 plus a length $L_3$ corresponding to the type of vehicle identified by the object tracking system (e.g., a representative car or truck length). Similarly, a distance for adjacent lane 37 comprises a range $R_3$ between position 46 and vehicle 38 plus an incremental length $L_2$ of vehicle 38 (either estimated or measured).

Figure 5:
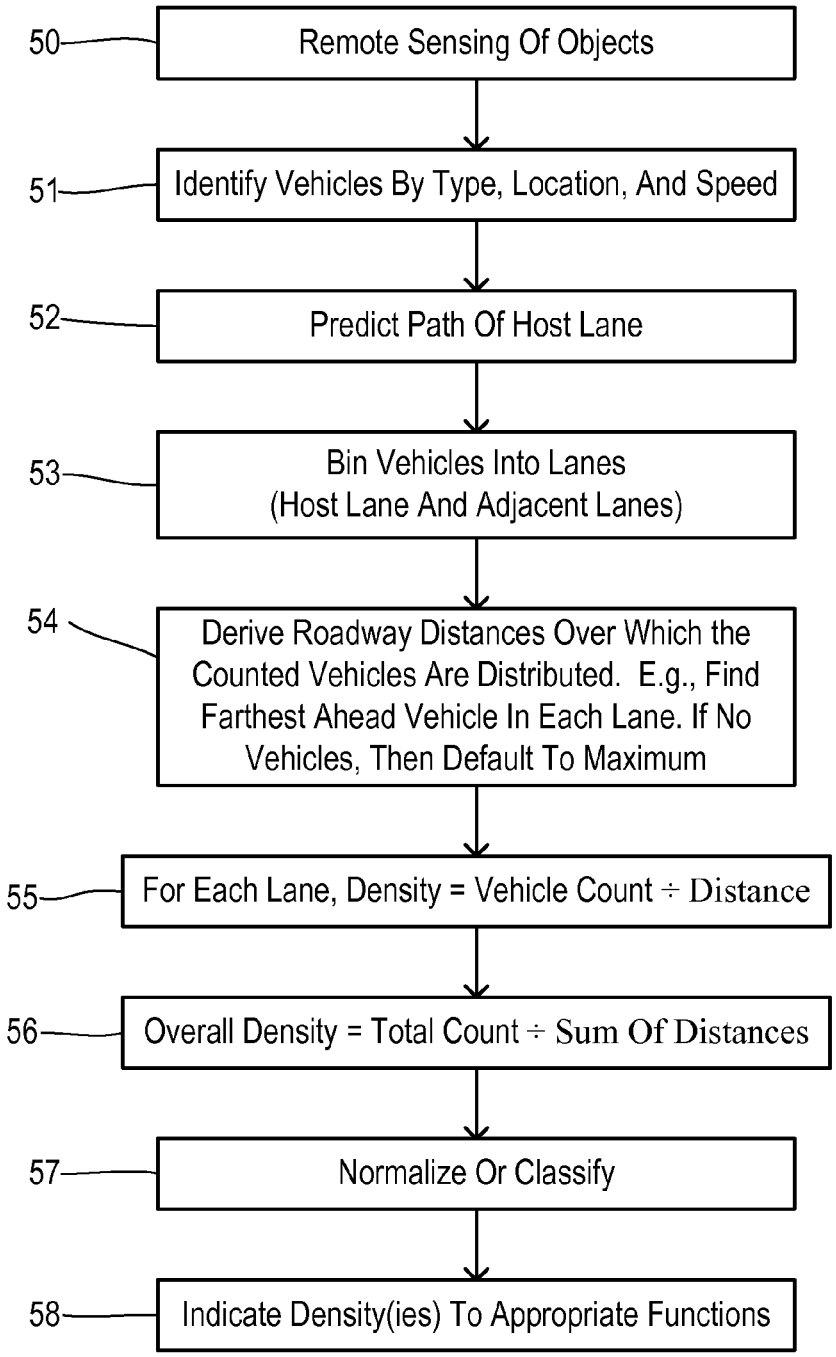
FIG. 5 is a flowchart of one preferred embodiment of the invention.

FIG. 5 shows one preferred method of the invention wherein remote sensing of objects around a host vehicle is performed in step 50. In the remote object detection system, the sensed vehicles are identified by type, location, and speeds for tracking over time in step 51. In step 52, the traffic density controller predicts a path of the host lane. Using the predicted path of the host lane and the corresponding positions of adjacent lanes which flank the host lane, all detected vehicles are binned into the lanes in step 53.

In step 54, the furthest ahead vehicle is found for each lane having a vehicle present. For the host lane, this distance along with the host length and furthest vehicle length is used to derive the distance over which vehicles in the lane are distributed. For the adjacent lanes, it is the furthest vehicle and length in combination with the closest detectable point in the lane that is used. If no vehicles are present in a lane, then the associated distance defaults to a maximum detection distance of the sensors along the predicted path of the respective lane. This predetermined maximum detection distance may be a fixed value stored in the controller or could be calculated based on environmental factors such as the height of the horizon. In step 55, a density is calculated for each lane equal to the respective vehicle count divided by the distance determined for each respective lane. In step 56, an overall density equal to the total count divided by the sum of distances is determined.

The raw traffic density values obtained in steps 55 and 56 can be directly used, or the raw values may be normalized or classified in step 57. Normalizing may preferably be comprised of transforming the values onto a scale between 0 and 1, determined as a percentage of a predetermined heavy traffic density threshold. For example, a raw value for an overall traffic density would be divided by the threshold and then clipped to a maximum value of 1. The predetermined heavy threshold may be empirically derived based on the prevalent traffic conditions in the market where the vehicle is to be sold and used.

Alternatively, classifying the raw traffic density values may be comprised of defining light, medium, and heavy traffic thresholds. Depending on the range in which the raw traffic density values fall, the corresponding level of light, medium, or heavy traffic density could be determined and reported to the other vehicle systems. Thus, the traffic density value or values, whether raw, normalized, or classified, are indicated to the appropriate functions or systems that need them in step 58.

Figure 6:
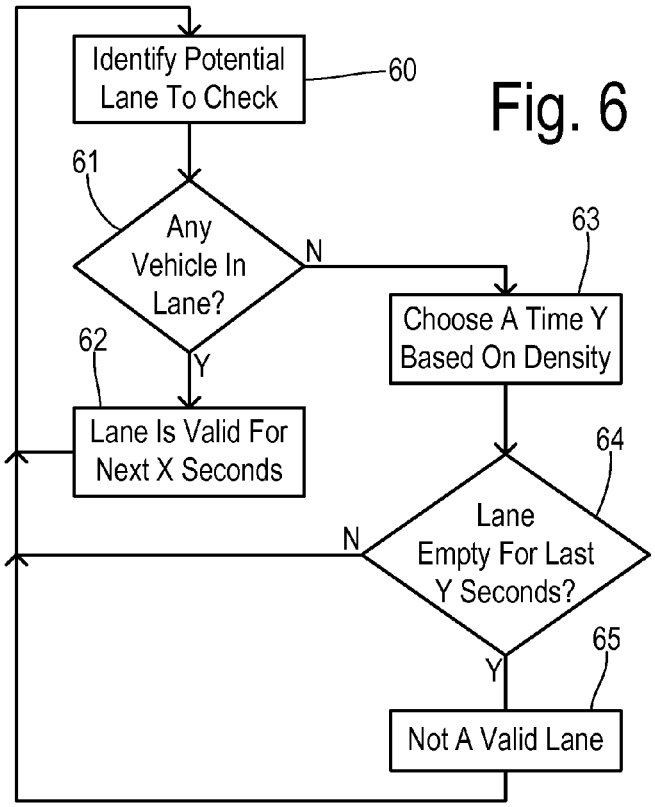
FIG. 6 is a flowchart of a method for validating adjacent lanes.

Preferably the method of the invention may be performed using only valid lanes that can be verified to exist around the host vehicle as shown in FIG. 6. For example, if the area corresponding to a potential adjacent lane is instead a shoulder of the road, then it would typically not be used in a density calculation. However, in some circumstances it may be desirable to monitor an object density in a shoulder region or other area to be used in identifying potential escape routes if potential collisions are detected.

To identify valid lanes, the method in FIG. 6 begins by identifying a potential lane to be checked in step 60 (e.g., from a predetermined range of two adjacent lanes on each side of the host vehicle). A check is made whether any vehicle is in the identified lane in step 61. If a moving vehicle is detecting in that lane, then the lane is considered valid for a predetermined period of time (e.g., 60 seconds) in step 62. Then the method returns to step 60 identifying a next potential lane check.

If no vehicles are detected in the currently-examined lane in step 61, then the method proceeds in step 63 wherein the present overall traffic density is used to determine a time value Y. In situations where a higher traffic density exists, the likelihood of an empty lane is reduced. In conditions of a light traffic density, the possibility of a valid lane being empty of vehicles for a longer period of time increases. Therefore, a time value Y is selected with a magnitude that reflects an average wait time during which it would be expected that a vehicle would again appear in the empty lane. In step 64, a check is made to determine whether the potential lane being checked has been empty for the last Y seconds. If not, then the lane is still considered valid and a return is made to step 60. If the lane has been empty for Y seconds, then it is not considered a valid lane in step 65. The invalid lane may typically be excluded from the density calculations until a vehicle is detected in that potential lane.

Figure 7:
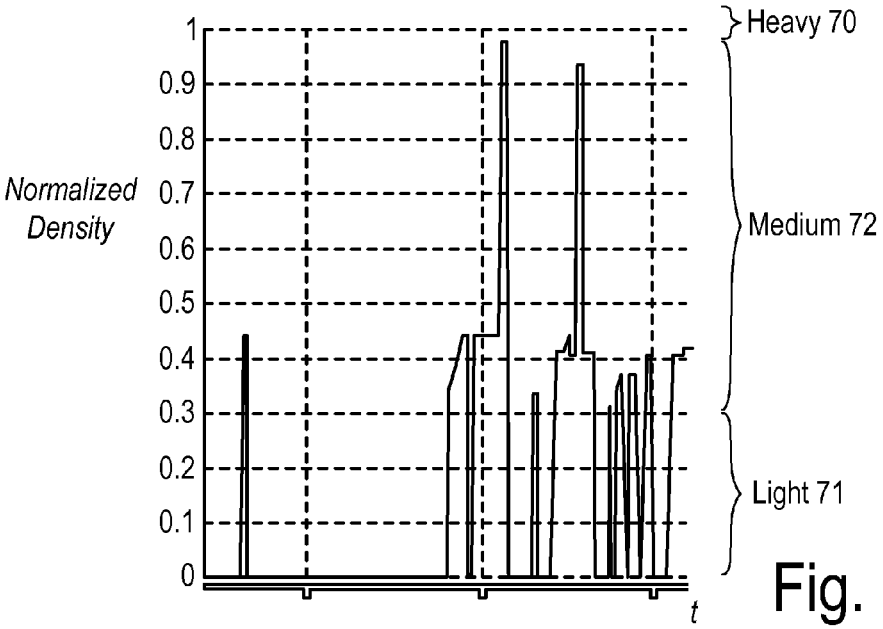
FIG. 7 is a plot of an estimated traffic density during one example of a portion of a driving cycle.

FIG. 7 shows exemplary traffic density values obtained during a driving cycle in various traffic densities. The densities have been normalized in a range of 0 to 1 based on a heavy traffic threshold 70. If it is desired to classifying the traffic densities into ranges, then a light traffic range 71 or a medium traffic range 72 can be reported to the other vehicle systems instead of the normalized value based on appropriate thresholds.

A further embodiment of the invention may include detecting a lane change maneuver of the host vehicle from an initial lane to a final lane, and then indicating a host lane traffic density as an aggregate of individual traffic lane densities for the initial lane and the final lane during the lane change maneuver. Yet another embodiment may include comparing a closing speed of a vehicle detected in an adjacent lane to a host speed of the host vehicle, and if the closing speed is greater than the host speed then the adjacent lane is indicated as an opposing lane.

What is claimed is:

1. A method for an electronic controller in a host vehicle to determine a traffic density, comprising the steps of:

a sensor remotely sensing objects within a field of view around the host vehicle;

identifying positions of nearby vehicles from among the sensed objects;

predicting a path of a host lane being driven by the host vehicle;

the electronic controller binning the nearby vehicles into a plurality of lanes including the host lane and at least one adjacent lane flanking the predicted path;

the electronic controller determining a host lane distance in response to a position of a farthest vehicle relative to the host vehicle that is binned to the host lane;

the electronic controller determining an adjacent lane distance in response to a difference between a closest position in an adjacent lane that is within the field of view and a position of a farthest vehicle binned to the adjacent lane;

the electronic controller indicating a traffic density in response to a ratio between a count of the binned vehicles and a sum of the distances.

2. The method of claim 1 wherein the host lane distance includes a length of the farthest vehicle binned to the host lane and a length of the host vehicle.

3. The method of claim 1 wherein the adjacent lane distance includes a length of the farthest vehicle binned to the adjacent lane.

4. The method of claim 1 wherein if no nearby vehicles are identified in the host lane, then the host lane distance is comprised of a maximum detection distance of the sensor along the predicted path.

5. The method of claim 1 wherein if no nearby vehicles are identified in the adjacent lane, then the adjacent lane distance defaults to a predetermined maximum detection distance.

6. The method of claim 1 further comprising the step of normalizing the ratio into a predetermined range prior to indicating the traffic density.

7. The method of claim 1 further comprising the step of classifying the indicated traffic density according to a light, medium, or heavy density.

8. The method of claim 1 wherein the electronic controller indicates individual traffic lane densities for the host lane and the adjacent lane.

9. The method of claim 1 further comprising the step of:

the electronic controller periodically determining validity of adjacent lanes along each side of the host lane, wherein an adjacent lane path is determined as a valid adjacent lane whenever a moving vehicle is coincident with the adjacent lane path.

10. The method of claim 9 wherein an adjacent lane path is determined not to be a valid adjacent lane whenever no moving vehicle is coincident with the adjacent lane path over a predetermined time period.

11. Apparatus comprising:

sensor in a host vehicle; and a controller receiving identification of nearby vehicles from the sensor, predicting a host lane path, binning vehicles into a host lane and adjacent lanes, determining a host lane distance and adjacent lane distances in response to positions of farthest vehicles in the respective lanes, and indicating a traffic density in response to a ratio between a count of binned vehicles and a sum of the distances.

12. An apparatus for monitoring traffic density around a host vehicle, comprising:

an object detection system, in the host vehicle, using remote sensing within a field of view around the host vehicle to identify positions of nearby vehicles; and a controller, in the host vehicle, coupled to the object detection system for a) predicting a path of a host lane being driven by the host vehicle, b) binning the nearby vehicles into a plurality of lanes including the host lane and at least one adjacent lane flanking the predicted path, c) determining a host lane distance in response to a position of a farthest vehicle relative to the host vehicle that is binned to the host lane, d) determining an adjacent lane distance in response to a difference between a closest position in an adjacent lane that is within the field of view and a position of a farthest vehicle binned to the adjacent lane, and e) indicating a traffic density in response to a ratio between a count of the binned vehicles and a sum of the distances.

13. The apparatus of claim 12 wherein if no nearby vehicles are identified in the host lane, then the host lane distance is comprised of a maximum detection distance in the field of view along the predicted path.

14. The apparatus of claim 12 wherein if no nearby vehicles are identified in the adjacent lane, then the adjacent lane distance defaults to a predetermined maximum detection distance.

15. The apparatus of claim 12 wherein the controller indicates individual traffic lane densities for the host lane and the adjacent lane.

16. The apparatus of claim 12 wherein the controller is further adapted for f) periodically determining validity of adjacent lanes along each side of the host lane, wherein an adjacent lane path is determined as a valid adjacent lane whenever a moving vehicle is coincident with the adjacent lane path.

17. The apparatus of claim 16 wherein an adjacent lane path is determined not to be a valid adjacent lane whenever no moving vehicle is coincident with the adjacent lane path over a predetermined time period.

* * * * *